US010947712B2

(12) United States Patent
Britz

(10) Patent No.: US 10,947,712 B2
(45) Date of Patent: Mar. 16, 2021

(54) DEVICE FOR DELAYING INTRODUCTION OF AGENTS TO A CISTERN

(71) Applicant: Howard Oliver Britz, Redcliffe (AU)

(72) Inventor: Howard Oliver Britz, Redcliffe (AU)

( * ) Notice: Subject to any disclaimer, the term of this patent is extended or adjusted under 35 U.S.C. 154(b) by 512 days.

(21) Appl. No.: 15/540,578

(22) PCT Filed: Apr. 24, 2015

(86) PCT No.: PCT/AU2015/000246
§ 371 (c)(1),
(2) Date: Jun. 29, 2017

(87) PCT Pub. No.: WO2016/168881
PCT Pub. Date: Oct. 27, 2016

(65) Prior Publication Data
US 2017/0370084 A1 Dec. 28, 2017

(51) Int. Cl.
*E03D 9/03* (2006.01)
*E03D 9/02* (2006.01)

(52) U.S. Cl.
CPC ..... *E03D 9/037* (2013.01); *E03D 2009/024* (2013.01)

(58) Field of Classification Search
CPC ..... E03D 9/037; E03D 2009/024
See application file for complete search history.

(56) References Cited

U.S. PATENT DOCUMENTS

2012/0073036 A1* 3/2012 Rizzo ..... E03D 9/037 4/231

* cited by examiner

*Primary Examiner* — Sean E Conley

(57) ABSTRACT

A refillable, stand-alone in-cistern device that is activated only by the rising and falling of the water in the cistern that will delay the introduction of a concentrated dose of liquid cleansing agent into the last part of the flush cycle of the toilet, thereby delivering a wide range of improved cleaning and deodorising consumer benefits. The invention only requires securement in any convenient position inside the cistern wall and requires no other customer installation maintenance.

12 Claims, 3 Drawing Sheets

3
8
14
1
Top water
2
13
4
9
5
6

DEVICE FOR DELAYING INTRODUCTION OF AGENTS TO A CISTERN

CROSS REFERENCE TO RELATED APPLICATION

This application is for entry into the U.S. National Phase under § 371 for International Application No. PCT/AU2015/000246 having an international filing date of Apr. 24, 2015, and from which priority is claimed under all applicable sections of Title of the United States Code including, but not limited to, Sections 120, 363, and 365(c).

The disadvantages of placing current in cistern cleaners directly into the cistern Currently in-cistern dissolving toilet blocks and other types of in solid dissolving in-cistern cleansing and deodorising agents are placed in the cistern to dissolve and defuse in the water throughout the cistern. This active agent will defuse throughout the water in the cistern but will tend to be more concentrated at the bottom of the cistern.

The result is that when the cistern is flushed, this more concentrated cleanser and colorant has settled at the bottom of the cistern is flushed away first with the waste in the bowl leaving the diluted and less concentrated colorant/deodorizing agent to flow into the toilet bowl last resulting in a diluted active agent remaining in the toilet bowl, thus lessening the desired visual and deodorising effect of the toilet block for the consumer.

Current in-cistern dispensing models diffuse the liquid agent throughout the cistern water between the flush cycles and do not delay its introduction into the cistern.

Different to Existing Inventions:

This invention is designed to delay the introduction of a cleaning/deodorising agent into the last part of the flushing cycle.

This invention is designed to keep the treated water in the device separate from the untreated water in the cistern between flushing cycles.

This invention is designed to be secured in a stable position that will enable the device to be partially submerged below the water line when the cistern is full and at rest position.

This invention is not activated or attached to or activated by any moving or mechanical part of the cistern mechanism.

This invention is a standalone module, operated independently only by the rising and falling water levels within the cistern.

This invention can be free form other than cylindrical as in the illustrations.

This invention has an embodiment that will enable a solid dissolving active agent to also be contained within the invention and released with the processed water at the end of the flushing cycle.

This invention may be designed as a combination of the invention without the embodiment (Solid dissolving agent) if desired.

This invention may be designed to use solid dissolving tablets only, or with a liquid dispenser, or only as a liquid dispenser or combined with one chamber for solid dissolving tablets only, and another separate chamber for liquid dispensing only or any variation thereof.

This invention, If desired can only operate with full flush and not activate on half flush.

This invention is intended to reduce the amount of chemicals into the eco system while providing improved benefits over existing products.

This invention can be made as a disposable or refillable unit as required.

This invention provides improved consumer benefits than that of placing the solid dissolving in cistern tablet into the cistern or existing stand-alone modular liquid dispensers.

This invention provides improved benefits to that of placing a liquid toilet bowl cleanser on the rim of the bowl.

This invention combines the use of a toilet solid in cistern tablet and a toilet rim liquid cleanser with improved consumer results by cleaning around the complete toilet bowl (Liquid cleanser) and delivering a more concentrated cleaning, but less dissolved solid in cistern cleaning agent to the bowl.

This Invention distributes the treated water from the cistern around 360 degrees around the toilet bowl and not only one side of.

This invention distributes the treated water from the cistern around 360 under the rim of the toilet bowl.

This invention is operated by the rising and falling water levels in the cistern and internal to the device to operate floatation systems within the device.

The treated water in the device exposed to the cleansing and deodorising/colorant in the device does not come in contact with water in the cistern when the cistern is not being flushed and the treated water in the container is sealed off from the rest in the cistern between flushing periods.

This Invention does away with complex designs and operates on the natural principles of science and the mechanical design of the device to independently operate separate water floatation devices to open and close entry and exit openings in the device for water to enter or exit the device to open and close the opening In the liquid container to control the flow of the liquid cleanser/active agent internally into the device. The invention is easily placed within the cistern and achieves this improved consumer benefits by only releasing a small dose of concentrated cleansing agent during the last part of the flushing cycle that flows and cleanses around the complete toilet bowl (360 degree around and below the rim of the toilet bowl). This is an improvement to existing toilet bowl rim clip on products clipped to one side only and therefore cannot clean around the whole toilet bowl.

Another improved consumer benefit is that the invention leaves a deeper coloured and a stronger deodorising effect in the toilet bowl between flushes, when the liquid container is used, the additional benefit of the device is that a consistently concentrated dosage of liquid active agent can now also be introduced into the toilet bowl at the last part of the flushing cycle as a foaming/deodorising agent irrespective of the time duration between flushes.

This is an improvement in consumer benefit achieved to simply dropping a solid dissolving in cistern tablet into the cistern that results in the most concentrated product being flushed down the toilet during the first part of the flushing cycle. When the liquid container is used, this could replace the need to use toilet bowl rim clip on systems that introduce liquid cleaning agents into the bowl but that only clean on one side of the toilet bowl where it is placed.

In essence this invention delivers in one package improved benefits to consumers by combining what in-cistern tablet products arid toilet bowl rim attachments seek separately to achieve, but not only does this invention deliver combined results of the two separate products, it also improves the results that each delivered separately.

The flotation devices are activated by the water levels within the device and the cistern.

This device is designed to be partially submerged within the cistern between flushing when the cistern is full and not activated. The fully submerged portion of the device has a vertical hollow protrusion connected to it that is opened at both ends, creating communication between the device interior to and the external environment that will allows a replacement cleaning agent container to be inserted and removed while the submerged device is in optimum position, to enable the introduction of the liquid agent container into the internal interior of the device, whilst preventing the surrounding cistern water from enter into the device through this vertical extension. This hollow vertical extension will not affect the operation of the device so that when the cistern is full, the submerged position of the device will allow the water in the cistern to flow through the top water entry hole (1) into the device.

This invention delays the release of the concentrated and treated water into the toilet bowl.

PRINCIPLE OF OPERATION OF THE INVENTION: REFER TO FIG. 1

Figure 1:
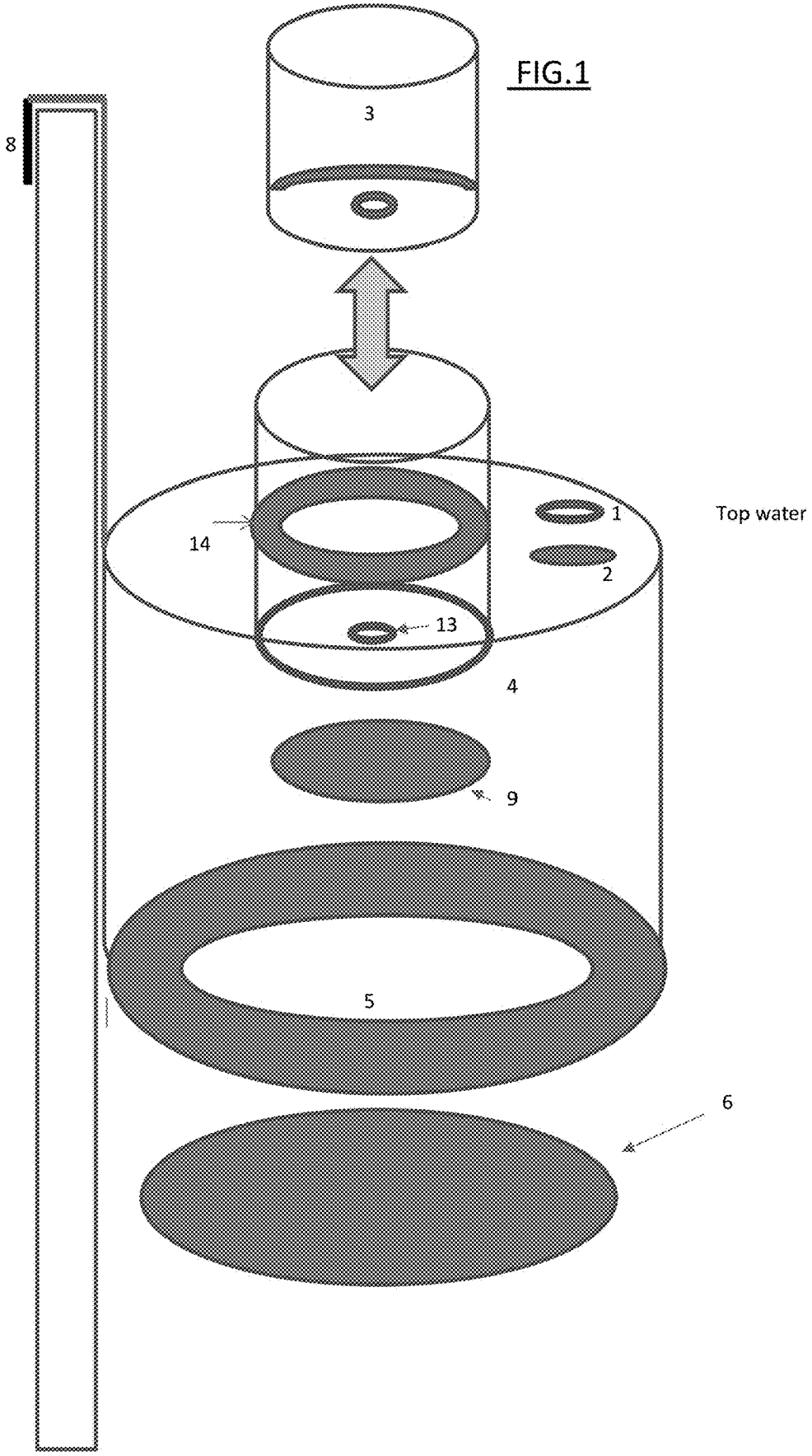
FIG. 1 depicts in cross section all of the openings of the dispenser, namely top opening (1), bottom opening (5) and exit hole from liquid agent reservoir (13) and the associated floats, namely (2) top float, bottom float (6) and liquid reservoir float (9) of the liquid agent reservoir that constitute the main components of the dispenser shown in-situ inside a toilet cistern.

"Active Ingredient" is deodorising/cleansing/colorant ingredient/cleansers/frothing agents, etc.

The invention has an embodiment in that, if desired to use a solid dissolving active agent instead of the liquid agent. This can be done by including a mechanical means that will prevent the float (9) from closing. Allowing the water contained in the device to be in constant contact with the solid dissolving agent to act on the water contained within the device.

The invention will allow the liquid in the enclosed container (4) to flow into the main enclosed device at a rate determined by the viscosity of the active liquid agent and the diameter of the opening at the bottom of the liquid cylinder (13) also determined by the rate at which the water flows into the enclosed device through (1).

(Not shown) A mechanical means can be introduced that will adjust the apertures of the openings (1), to regulate the rate of water inflow into (1) or the amount of liquid agent out of (13), into the device, or both, for customers convenience.

The level of water within the device will operate the float (9) opening and closing, and therefore controlling the flow of liquid into the device.

The device operates by means of an opening on top (1) and the bottom (5) of the device to allow air and/or water to enter or escape through these openings in the said device.

Separate, independent water floats (2) (6) and (9) are activated by water and are either independently opening or closing the said openings (1) and (5) at the ends of the device, and that at the bottom of the liquid container (13).

The floatation material used need to create an effective seal when closed.

The diameter of the floats (2.&6) are such that they are wide enough to seal the openings but of smaller diameter than that of the diameter of the device to allow water to freely pass between the walls of the device and the floats when they are not sealing off the top and bottom openings of the device, The flotation device (9) is of diameter of sufficient width only to close up the holes or openings at the bottom of the liquid cylinder (13) and therefore has negligible effect on the flow of water within the device.

Figure 3:
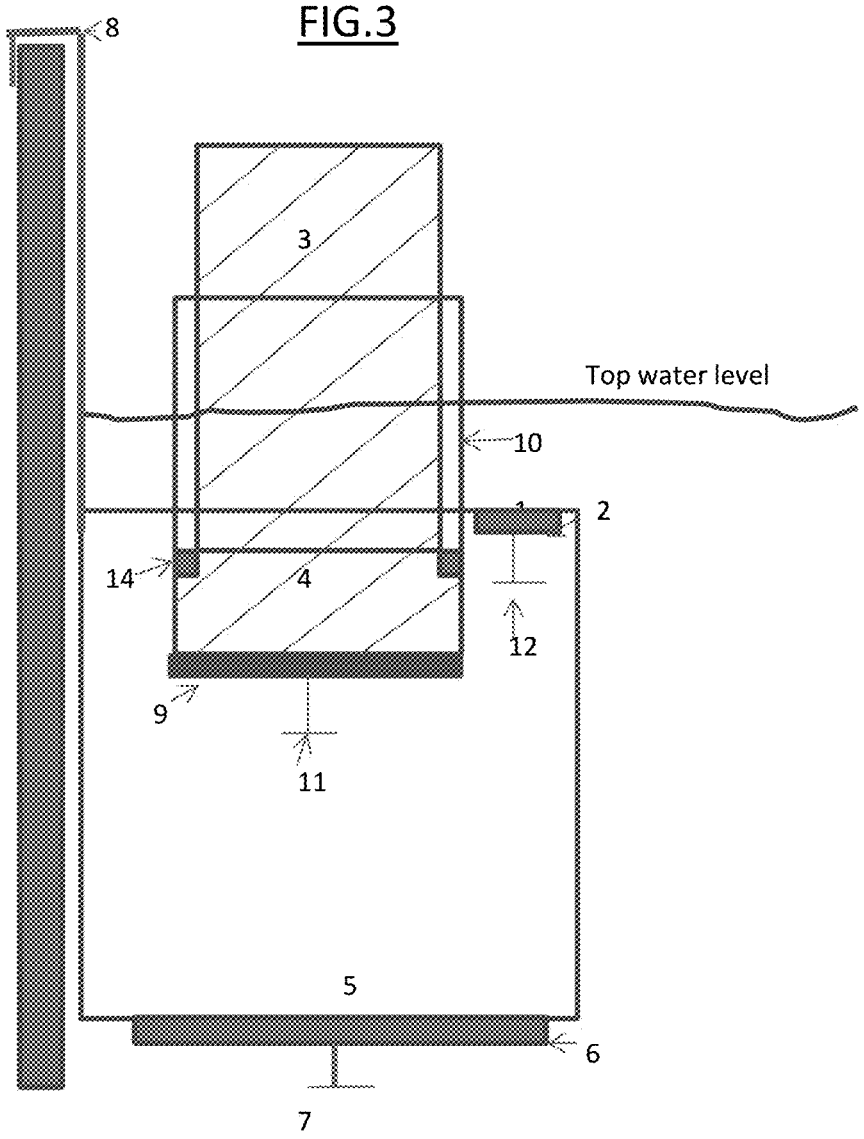
FIG. 3 depicts a cross section view of the dispenser in-situ with the water levels in the cistern at its zenith, illustrating all floats (2) (6) & (9) in their buoyant position, closing off all the openings (1) (5) & (13). The respective floatation guides and retainers for the respective floats (2) (6) & (9) are depicted as (12) (7) & (11) respectively. The liquid refill (3) is shown placed into the dispenser.

WRT FIG. 3, the floatation devices (2) (6) and (9) have a mechanical means (7) (11) and (12) in place and do not have any effect on the water flow and are only intended to keep the floats in place and contained in the device.

The figure is only for explanatory reasons and does not represent the actual dimension or final design of the invention as the invention may have variations in the design that will operate on the same principles. An example of a variation is that a hinged bottom flap trapdoor" may be used instead of the free-floating example in this design. The device may also be free form in the shape other than a cylinder.

These 3 independent water floats of the device are operated by water levels in the cistern and within the device that either open or close the 3 openings in the device, depending on the water levels in the cistern and within the device. The shape of the device may be round, square or freeform depending on the manufactures design preferences.

PRINCIPLE OF OPERATION WITH REFERENCE TO FIG. 2

The figure is only for explanatory purposes and does not represent the actual dimensions or final design of the invention as the invention may have variations that will operate on the same principles.

The active ingredient contained in the replaceable container (3) is introduced into the device through the top opening of the vertical partially submerged conning tower (10) and will fit smugly and securely into this container and rest on the stoppers (14) creating a liquid reservoir space (4) between the bottom of the active replaceable container (3) and the bottom of the cylinder (10) into which the active liquid will begin to flow.

The replaceable active ingredient container (3) will either have been mechanically opened prior to inserting into the cylinder (10) or may be chemically opened by contact with water in the device, or other means that will open the container when in place. The active ingredient container (3) is filled with a liquid active agent. This could be a foaming/perfuming agent if desired.

The main body of the device is placed below the waterline in the cistern at a point that when the cistern if full and the stopcock has turned off the flow of water into the cistern, the main body of the device is then fully immersed under water in the cistern in an upright position that will have the opening on the top and the bottom of the device in a vertical axis to allow the floats to be activated by the changing water levels in the cistern during the flushing or filling cycle of the cistern, but in a position that the top opening of the vertical inlet cylinder "conning tower" (10) is above the water line preventing water from the cistern entering through it but the main body below the water line to enable water from the cistern to enter through the top opening (1).

The device is held securely in place by a mechanical holder (8) system, attached to the inside or any other secure part in the cistern that does not allow movement of the device subject to the water levels within the cistern and does not Impede the normal operation of the flushing mechanism of the cistern. This could also be a U clip/clamp system attached to the top of the cistern between the cistern and the top cistern lid. The intention is that the length of the holder (8) is of such length that it will fit without adjustment into the majority of cisterns; however, it may be adjustable in length for optimum operation.

The top of the conning tower type protrusion (10) protrudes above the water line of the cistern for easy access by consumers to replace the spent and empty active agent container with a suitable custom-made refill. This could be in the form of any shape and form that fits snugly and securely into the opening (10) with preference given to a unique design that can be further protected by law.

The customer therefore does not need to place their hands into the water inside the cistern when inserting or removing the device, and of such length that it will position the device below the water line at the desired height for optimum performance.

The intention is for easy access when inserting or replacing the replacement active agent container through the portal above the water line when the cistern is full, but holding the device below the waterline in its optimum position. The invention also allows easy access to replace the empty active agent containers whilst the device is in place within the cistern as the replacement active agent container top is protruding above the cistern water line, whilst the device is in its optimum position.

The optimum position which in to secure the device within the cistern that will result in the best results are when the bottom end of the device that hold the bottom float is in a position that is such that when the flushing cycle causes the water level in the cistern to have lost approximately 80-90% of its contents, the bottom float of the device will drop, opening the bottom of the device, causing the treated water within the device to flow into the cistern and mix with the last portion of the water still flushing into the toilet bowl to colour and deodorise this last portion of the cistern flushing cycle that will remain in the toilet bowl.

PRINCIPLE OF OPERATION OF THE INVENTION WRT: FIG. 3

Figure 2:
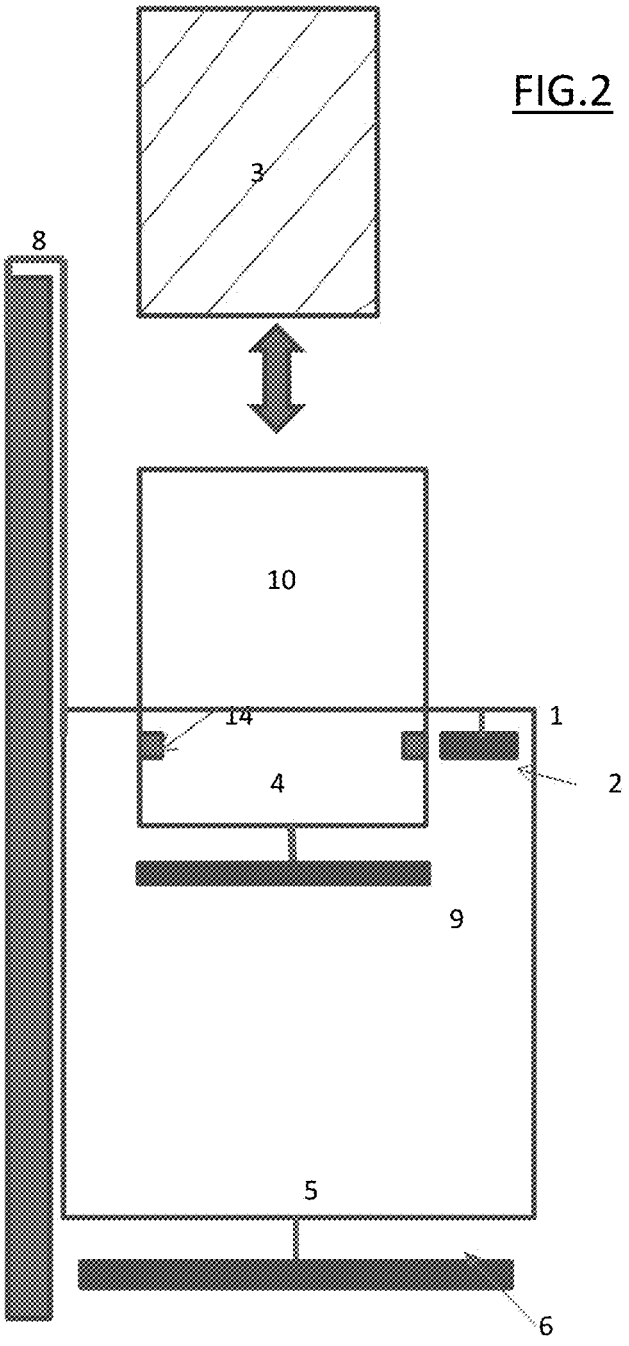
FIG.2 depicts a cross section view of the dispenser in-situ with the water levels in the cistern at its nadir, illustrating all floats (2) (6) & (9) in the open position, resulting in all openings (1) (5) & (13) in the open position. The two directional arrow illustrates the ability to remove the liquid refill (3) while the dispenser is in-situ.

FIGS. 1, 2 and 3 are for operational illustration purposes only.

Assumptions

The device has been securely placed In its optimum position and the cistern is full and all floats are closed.

When the device is initially purchased from the retailer, the container (3) hosting the liquid active agent will be closed to contain the liquid agent within the container (3) and will be opened either manually or when in contact with water to remove a/the dissolving/soluble solution or tape, or other mechanism device that will enable to active liquid agent to flow into the liquid reservoir space (4) created when the container (3) is fitted into the portal/conning tower (10) and rests on the supports (14).

Assumptions for Reasons of Explanation:

The cistern and the device is full at this point in time as in FIG. 3

The liquid refill container (3) is securely in place within cylindrical conning tower (10) and resting on supports (14) and the liquid reservoir (4) is now full of active liquid agent.

The device has been in the cistern prior to this description of operation and the floatation (2),(6) and (9) has been freed to move within its restricted zone.

The device has been placed into the cistern and is secure in the optimum fixed position as previously described.

When the cistern is flushed, the water level in the cistern will begin to drop until such time that the mechanical interaction of the forces of the upward pressure of the float and the gravitational downward pressure of the water in the device cause the bottom float (6) to open, resulting in the treated water in the device being introduced into the later flushing cycle of the cistern.

This first flushing cycle with the device in place will not produce any discernible difference to the consumer as the active agent has not yet been introduced into the device and the advantages of the invention become apparent from the second flush onwards.

As in FIG. 2, the cistern is now empty and the device has now expelled the water contained within it and all floats are now at rest and held in place by their respective floatation guides (7) (11) and (12)

There is still no water in the device therefore flotation (9) does not float and therefore allows the opening (13) at the bottom of the liquid cylinder (3) to dispense a measured dose of active liquid agent into the device.

By design, this measured dose of liquid agent is prevented from falling out of the still open hole at the bottom (5) of the device until such time the bottom hole (5) is closed off by the bottom float (6) between flushes. This can be achieved by not directly aligning the bottom of the hole (13) that releases the liquid agent into the device with the bottom opening (5) so that the liquid agent does not drop straight through, but on the sides of the bottom exit hole (5) until such time the bottom float (6) Is activated and closes off bottom exit hole (5). Other design means may also be employed to achieve the same result.

The water in the cistern will continue to rise until such time that the bottom float (6) is activated and closes off the bottom opening (5)

As the water level continues to rise past the top opening (1) of the device, water will now being to enter into the device through the top opening (1) this water will continually replace the air in the device as it fills the device, but as it is not yet full, the floatation device (2) will be laying at the bottom of its retainer (12) leaving the top opening (1) still open for water to continue to enter into the device and air to escape.

When the water in the device reaches a level that will cause flotation (9) to float and close off the hole (13) at the bottom of the liquid cylinder (3) this will stop the liquid active agent flowing into the cistern. The device will still continue to be filling up with water until full.

When the device is full of water, all the air has been replaced by water in the device this will now cause the top float (2) to float and seal off the top opening (1). The top floatation device is now pressed to the top of the hole (1) and now creates an effective air seal at the top of the device.

Both the top (1) and bottom openings (5) of the device are now closed as well as the middle internal liquid dispenser opening (13) internal to the device.

The water within the device is now separated and isolated from the water in the cistern.

The contained water in the device that is sealed off from the rest of the water in the cistern is now subjected to the effects a dose of the released liquid active ingredient.

This treated water will be contained within the device until for released into the cistern when the toilet is flushed. Flushing the Cistern The flushing action will cause the water in the cistern to begin to drop below the top opening, but the bottom opening will still be closed and not immediately open with the initial falling water levels in the cistern and will still be closed by the combined action of the effective air lock (upward vacuum forces) created by the air sealing effect of the top floatation device, and the upward water (mechanical) pressure of the bottom float.

Until a point where the mechanical design specifications of the device and the natural forces of nature overcome the combined forces that have kept the bottom float (6) in place, the float will drop and release the treated water within the device through the bottom opening (5) into the cistern. When placed at the optimum position, this is when the water level in the cistern has dropped to close to the bottom of the cistern and introduces the treated water that was isolated into the toilet bowl at the end of the flushed water entering the toilet bowl to deliver the range of consumer benefits that this invention offers.

This causes the desired delaying action.

This will cause the concentrated treated water from the device to be mixed with the last of the untreated water in the cistern flowing into the toilet bowl.

The result of this is that this treated water will remains in the toilet bowl and will be a deeper colour with a stronger deodorising effect than was achieved with by simply placing the solid tablet in the cistern or using a liquid toilet bowl rim attachment.

The liquid introduced into the device could be a foaming and/or perfuming agent that will be activated to foam (if desired) by the turbulence action of the water rushing into the bowl.

The cistern will be empty or nearly empty, depending on its design, and whether a full or half flush was selected and will begin to automatically refill again, this will set in motion the cycle as described, and the above process will be repeated. There will be a small residual amount of treated water in the cistern, and this will become lighter as the cistern fills. This lighter colour will be evident first on the next full flush cycle, prior to the deepened deodorised appears, or will be the only colour evident when half flush is selected.

When the active ingredients are exhausted the refill may be replaced by removing the container (3) and replacing it with a new one without the need to remove the device from its place in the cistern.

Another advantage is that manufacturer can give the environmental conscious consumers the option of using a product that releases fewer active chemicals into the environment to achieve an improved effect over the existing practice of simply placing the solid deodorising/colorant into the cistern.

Another advantage is that for dual flush cisterns, when placed at the correct position, the device will not activate and release new concentrate into the toilet bowl on a half flush activation. There will nevertheless be a lighter colour flowing into the bowl as a result of residual colorant from a prior full flush.

The advantage of this is that there is an environmental consideration that the device will only add new active agent into the sewer system on a full flush.

PRINCIPLE OF OPERATION OF EMBODIMENT

A solid dissolving agent can be used instead of the liquid option within the same device by adding a mechanical means to keep the float (9) open at all times to enable the water in the device to be in constant contact with the solid dissolving agent. This can be achieved by mechanical design on the solid agent container (3) that will be the same dimension as the liquid agent container, however with modification to enable operation. The solid dissolving container should be in the shape of a cylinder opened at the end that is inserted into the conning tower opening (10) as with the liquid agent.

The disadvantage is that treated water introduced into the toilet bowl will not have the consistent strength and colour advantages offered with using the liquid agent, due to dissolving strength being dependent on the time the agent solid agent has had to dissolve in the water, but will delay the introduction of the treated water within the device into the toilet bowl as well.

This embodiment may use the combination of the liquid and the solid tablet, or either by itself.

The features described with respect to one embodiment may be applied to other embodiments or combined with or interchanged with the features other embodiments, as appropriate, without departing from the scope of the present invention.

Another embodiment is that the principles of operation of this device can applied in other fields where a liquid agent is required to be introduced into another agent as a delayed action.

LEGEND WITH RESPECT TO FIGS. 1, 2 & 3

1 Top opening
2 Top float
3 Liquid Refill
4 Liquid agent reservoir.
5 Bottom opening
6 Bottom float
7 Floatation guide and retainer.
8 Adjustable securing arm to cistern wall
9 Liquid reservoir float
10 Conning tower and refill holder.
11 Floatation guide and retainer
12 Floatation guide and retainer.
13 Exit hole from liquid agent reservoir
14 Refill support stopper and seal

What is claimed is:

1. A modular apparatus for fixing in place within a cistern, operated and activated only by forces of gravity and rising and falling water levels acting on buoyant members for creating a dose of treated water by mixing a fixed amount of cistern water with a dose of sanitizing agent and isolating said treated water from a body of surrounding quiescent water in the cistern, until releasing said treated water into the cistern near an end of a cistern flushing cycle of a flushing toilet, enabling the delaying of mixing of said treated water with a last portion of untreated cistern water to flush into a toilet bowl; preferably after waste has been flushed away inside the toilet bowl; said treated water will be applied to the whole internal surface area of the toilet bowl over which treated cistern water flows and under a rim of the toilet bowl; the delaying of the mixing of said treated water with the last portion of untreated cistern water resulting in most of the treated water remaining within the toilet bowl between flushes, the apparatus, comprising:

a body comprising a refillable active ingredient holding container adapted to hold the sanitizing agent, said holding container including a base, a wall and a block-able opening through which the sanitizing agent may be dispensed; said holding container may be configured to enable either the use of a solid or liquid sanitizing agent, and a second container disposed generally below said holding container;

a first buoyant member moveable relative to, said body, said first buoyant member being configured to directly block or unblock said block-able opening to release the sanitizing agent from said holding container directly into the second container when water in the second container reaches a first predetermined level;

a second buoyant member movable relative to said body and configured to block and unblock an opening in a base of said second container; said opening in the base of said second container is an outlet to allow the treated water to exit the second container into the cistern when water in the cistern reaches a second predetermined level;

a third buoyant member movable relative to said body, wherein the second container comprises an inlet opening to allow cistern water to enter into said second container, and said third buoyant floating member is configured to directly block or unblock said inlet opening of the second container when water in the second container reaches a third predetermined level;

said apparatus operating, wherein said first buoyant member, second buoyant member and third buoyant members move at different predetermined water levels to directly block or unblock their respective openings, said first, second, and third buoyant members are not required to perform any secondary functions other than blocking or unblocking their respective openings, and;

an adjustable securing arm to secure said body to a portion of the cistern, to be partially submerged in an operating position, without the need for the customer to modify the cistern or attach any part of the apparatus to any moving parts of an operating mechanism of the cistern.

2. The apparatus of claim 1, wherein said second container is in communication with said holding container, said second container holding a volume of said treated water.

3. The apparatus of claim 1, wherein said opening in the base of said second container is large enough to enable immediate discharge of liquids when opened.

4. The apparatus of claim 1, wherein said holding container and said second container are oriented along a common vertical axis, and in direct mechanical and liquid communication.

5. The apparatus of claim 1, wherein said second container has a volume greater than that of said holding container.

6. The apparatus of claim 1, wherein the sanitizing agent is a tablet sanitizing agent.

7. The apparatus of claim 1, wherein the sanitizing agent is a liquid sanitizing agent.

8. The apparatus of claim 1, wherein the treated water is released from a dispenser in the last part of the flushing cycle.

9. The apparatus of claim 1, wherein the said apparatus includes said holding container for holding said sanitizing agent and said second container, for isolating said treated water prior to releasing said treated water; further comprising the step of allowing a portion of the sanitizing agent in the holding container to migrate, by gravity feed from said holding container to said second container.

10. The apparatus of claim 1, further comprising stopping migration of the sanitizing agent from the holding container into the second container when the volume of water in the second container has reached its maximum capacity.

11. The apparatus of claim 1, wherein filling of the second container with cistern water; treating of the water within the second container by said sanitizing agents from said holding container; and releasing of said treated water into the cistern, all occur within rising and falling water levels on only one complete flushing cycle.

12. The apparatus of claim 1, wherein a replacement sanitizing agent is contained within a separate and removable replacement active ingredient container, said replacement active ingredient container may hold a liquid agent or be a solid dissolving tablet, said replacement active ingredient container being removed or replaced without the need to remove the apparatus from its position in the cistern.

* * * * *